United States Patent [19]

Masada et al.

[11] Patent Number: 4,582,592

[45] Date of Patent: Apr. 15, 1986

[54] PROCESS FOR HYDROPROCESSING HEAVY HYDROCARBON OILS SUCH AS PETROLEUM RESIDUA IN THE PRESENCE OF ADDED FLUORINE

[75] Inventors: Gary M. Masada, Corte Madera; Kirk R. Gibson, El Cerrito, both of Calif.

[73] Assignee: Chevron Research Company, San Francisco, Calif.

[21] Appl. No.: 452,830

[22] Filed: Dec. 23, 1982

[51] Int. Cl.[4] ..... C10G 47/02; C10G 45/04

[52] U.S. Cl. ..... 208/108; 208/112; 208/213; 208/216 R

[58] Field of Search ..... 208/108, 213, 112, 216 R

[56] References Cited

U.S. PATENT DOCUMENTS

| | | | |
|---|---|---|---|
| 2,221,952 | 11/1940 | Pier et al. | 208/108 |
| 2,953,516 | 9/1960 | Gardner | 208/108 |
| 3,159,569 | 12/1964 | Hansford | 208/110 |
| 3,268,439 | 8/1966 | Tupman et al. | 208/108 |
| 3,717,586 | 2/1973 | Suggit | 208/108 |
| 4,420,388 | 12/1983 | Bertolacini et al. | 208/112 |

FOREIGN PATENT DOCUMENTS

| | | | |
|---|---|---|---|
| 148028 | 2/1953 | U.S.S.R. | 208/108 |

*Primary Examiner*—William R. Dixon, Jr.
*Assistant Examiner*—Cynthia A. Prezlock
*Attorney, Agent, or Firm*—Burns, Doane, Swecker & Mathis

[57] ABSTRACT

Addition of organofluorine compounds to heavy hydrocarbon oils, particularly petroleum residua prior to catalytic hydroprocessing extends hydroprocessing catalyst life.

10 Claims, 1 Drawing Figure

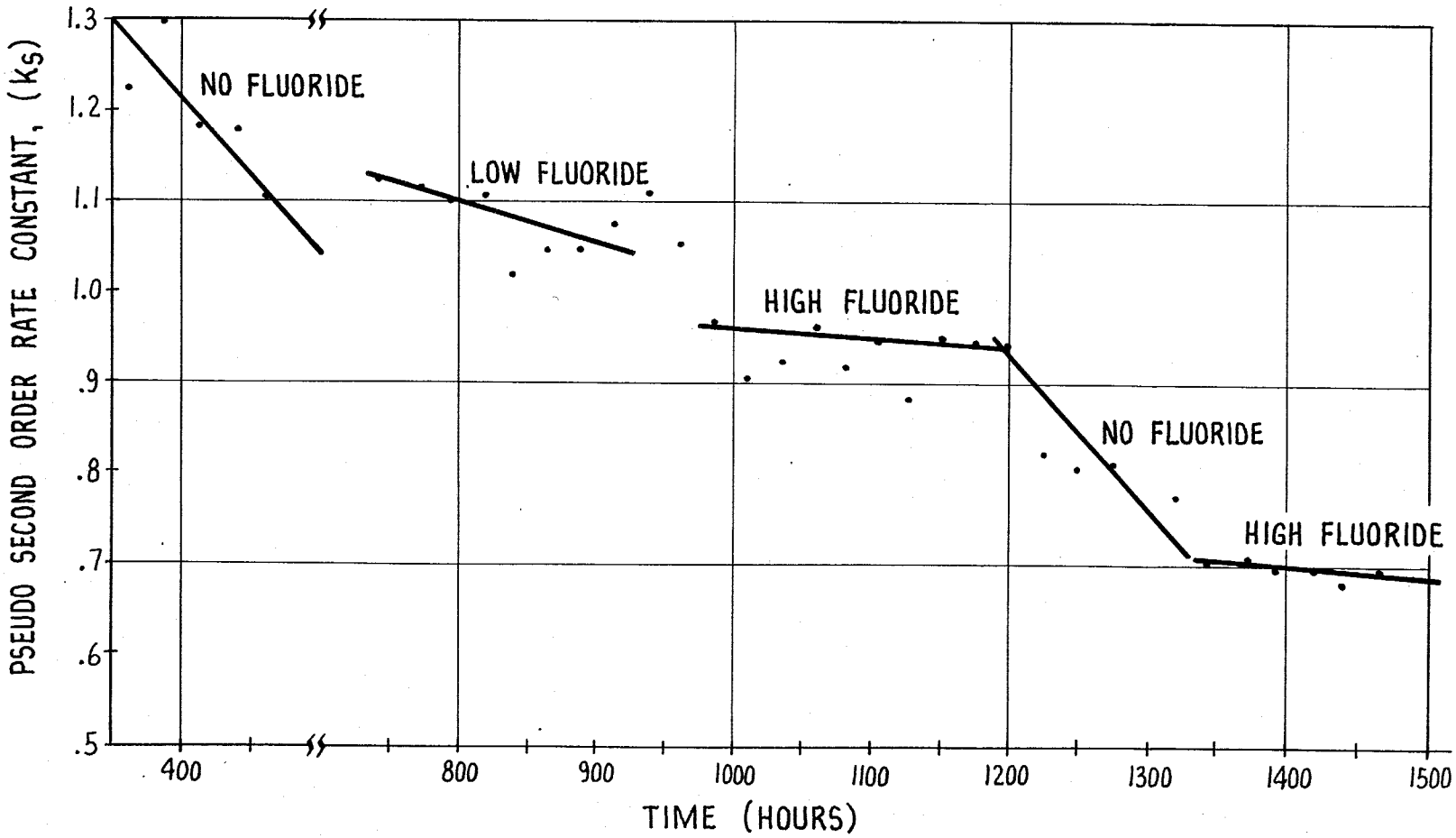
NO FLUORIDE
LOW FLUORIDE
HIGH FLUORIDE
NO FLUORIDE
HIGH FLUORIDE
1.3
1.2
1.1
1.0
.9
.8
.7
.6
.5
400
800
900
1000
1100
1200
1300
1400
1500
TIME (HOURS)
PSEUDO SECOND ORDER RATE CONSTANT, ($k_S$)

PROCESS FOR HYDROPROCESSING HEAVY HYDROCARBON OILS SUCH AS PETROLEUM RESIDUA IN THE PRESENCE OF ADDED FLUORINE

BACKGROUND OF THE INVENTION

1. Field of the Invention

The present invention is in the field of catalytic hydroprocessing of heavy hydrocarbon oils, particularly liquid petroleum residua and shale oils. More particularly, it concerns an improvement in catalytic hydrodesulfurization and hydrocracking of such heavy oils.

2. The Prior Art

The atmospheric or vacuum distillation of crude petroleum produces a residuum (bottoms) that contains sulfur and a substantial proportion of asphaltenes and other hydrocarbons boiling above 600° C. Similarly, shale oil contains substantial fractions of these materials. In times past, these heavy fractions could economically find application in paving materials and the like. Today, however, the cost of petroleum demands that these materials be processed to form more valuable relatively low sulfur-relatively lower boiling hydrocarbon materials which can be used as fuels. It is known in the art that this reduction in sulfur and conversion to lower boiling hydrocarbons can be effected by contacting the residiuum or shale oil with hydrogen and a solid catalyst at elevated temperatures. Representative patents to such processes include U.S. Pat. No. 3,558,474 of Gleim, et al, and U.S. Pat. No. 3,841,996 of Jacobsen.

It will be appreciated that is is economically attractive to maximize the balance of catalyst life and activity to minimize heat imputs and catalyst replacement. It further will be appreciated that these heavy hydrocarbon feedstocks, by their very nature as bottoms fractions, contain substantial amounts of catalyst deactivators. It is a fundamental object of this invention to improve the stability of the catalysts used in hydroprocessing of these heavy petroleum feedstocks and thereby increase the useful life of these catalysts and improve the economics of heavy petroleum hydoprocessing. This object is accomplished herein by adding a fluoro component to the hydroprocessing feedstocks. Patents relating generally to petroleum processing in the presence of halogens or halogen compounds include:

U.S. Pat. No. 2,221,952 of Pier et al
U.S. Pat. No. 2,344,789 of Schmerling
U.S. Pat. No. 2,357,495 of Block
U.S. Pat. No. 2,953,516 of Gardner
U.S. Pat. No. 3,088,908 of Hansford
U.S. Pat. No. 3,305,477 of Peck et al
U.S. Pat. No. 3,717,586 of Suggitt et al.

STATEMENT OF THE INVENTION

It has now been found that supported nonprecious metal catalysts employed in the hydroprocessing of heavy petroleum feedstocks such as petroleum residua exhibit greater stability and longer life when from 50 to 1500 ppm by weight of fluorine as an organofluoro compound is admixed with the petroleum feed. In another aspect, this invention provides an improved process for hydrodesulfurizing a sulfur-containing heavy petroleum feed which comprises (a) admixing with said petroleum feed from 50 to 1500 parts per million by weight of fluorine as an organofluorine compound as from a fluoride enriched feed and (b) passing the fluoride-enriched feed and hydrogen over a nonprecious metal-containing hydrodesulfurization catalyst at hydrodesulfurization conditions.

THE DRAWING

This invention will be described with reference being made to the accompanying drawing in which the sole FIGURE is a graph depicting catalyst activity as a function of period of use.

DETAILED DESCRIPTION OF THE INVENTION

In accord with this invention, an organofluorine compound is admixed with a sulfur-contaminated feedstock prior to removing the sulfur by hydrodesulfurization.

The Organofluorine Compound

The organofluorine compound added to the feedstock is an organic fluoride usually an alkyl or aryl fluoride. Preferably these fluorides have a high fluorine content such as is achieved by multiple fluorine substitution—i.e. in organic difluorides, trifluorides, tetrafluorides and the like. Representative groups of fluoro compounds include alkyl fluorides having 1 to 8 carbon and 1 to 8 fluorine atoms per molecules; aryl and alkaryl and aralkyl fluorides of from about 6 to about 16 and preferably, about 6 to about 10 carbons and from 1 to about 8 fluorines per molecule. Examples of such materials include difluoroethane, tetrafluoroethane, hexafluoroethane, difluoropropane, tetrafluorohexane, benzylfluoride, benzyldifluoride, fluorotoluene and trifluorotoluene. Among these materials, trifluorotoluene is preferred.

The amount of organofluorine compound added should be controlled. At levels above about 1500 ppm by weight fluoride, (basis feedstock) the fluoride has too detrimental an effect on catalyst activity. At levels below about 50 ppm, little effect is noted. Preferably from 100 to about 1250 ppm of fluoride is added with 150 to 750 ppm being most preferred.

Feedstocks Treated

Feedstocks which are advantageously processed using the present invention include petroleum residua—both vacuum residua and atmospheric residua. Shale oil feedstocks can also be processed. These feedstocks are characterized as containing substantial fractions of materials boiling above 600° F. For example, an atmospheric residuum may contain from 1/5 to 3/5 of such materials while a vacuum residuum can be almost entirely such materials. Typical feedstocks include:

| | Gravity |
|---|---|
| Venezuela Vacuum Residua | 10.9 |
| California Vacuum Residua | 5.9 |
| Iranian Heavy Vacuum Residua | 6.3 |
| Arabian Heavy Vacuum Residua | 4.6 |
| Iranian Heavy Atmospheric Residua | 14.4 |
| Arabian Heavy Atmospheric Residua | 11.5 |
| Shale Oil | 19.7 |
| Shale Oil | 20.2 |

These materials may be further characterized as containing from about 20 to about 2000 ppm of metals—particularly nickel and vanadium and as containing from 0.5 to 10% by weight of organic sulfur. These feedstocks may have received pretreating such as washing to remove salts or deasphalting, for example propane deasphalting.

The Reactions Improved

The reactions to which this invention pertains are heavy petroleum hydroprocessing reactions which employ heterogeneous catalysts. These reactions include catalytic hydrodemetallation, catalytic hydrodesulfurization and catalytic hydrocracking of petroleum residua and heavy shale oils. The improvement achieved by this invention is most apparent in the catalytic hydrodesulfurization reaction.

These three reactions tend to go on simultaneously to some extent. However through catalyst and condition selection they may be performed in sequence in separate stages, usually in the order of demetallation - desulfurization - cracking, or two or more of these may be performed in a single stage. The fluoride is usually added to the feed before the feed enters the hydrodesulfurization stage. The addition may be made before the hydrodemetallation stage as well.

These reactions all employ solid heterogeneous catalysts. These materials are generally particulate and may be present as fixed, fluidized or moving beds. The particle size will in general depend upon the type of bed employed. Fixed beds employ larger particles—say 20 to 4 mesh or larger while fluidized beds use relatively smaller particles—say 300 mesh to 12 mesh.

The catalysts employed are generally supported nonprecious heavy metal catalysts. These materials include an inorganic oxidic or silicious support or activated charcoal or the like with the desired metals deposited on its surface. Such supports include for example alumina, silica-alumina, silica, boria, titania, zirconia, and activated carbon. The metals employed are members of Groups VI and VIII of the Periodic Table of the Elements and include nickel, tungsten, molybdenum, cobalt and the like and mixtures thereof. Iron and vanadium are also suitable metals. The metals are generally present as oxides or sulfides. Conventionally known supported hydroprocessing catalysts such as NiMo, NiW, CoMo or CoW on alumina or silica-alumina or activated charcoal can be employed. Other examples of supported metal catalysts include NiFe, NiCo, and NiV. The amount of metal present on the catalyst may vary depending on the hydroprocessing reaction involved. With hydrodemetallation, metal loadings of 10% or less i.e. 1 to 6% based on total catalyst weight give good results. Loadings of up to 10 or 15% by weight or more can be employed for hydrodesulfurization and are included within the scope of this invention.

The fluoride addition can also offer advantages in hydrodemetallation stages employing nonmetallic high surface area sorption catalysts. Very simply, these catalysts are the supports listed above without any metals intentionally deposited on their surface. In both cases alumina is a preferred catalyst component. It is of course, possible and suitable to the practice of this invention to employ different catalysts for two or more of these three hydroprocessing reactors.

These processes improved by fluoride addition are all hydroprocesses—that is they all involve substantial pressures of added hydrogen—especially enough hydrogen to generally assure a gaseous hydrogen phase in the reaction zones. Typically hydrogen pressures of 250 to 3500 psig are employed, especially 750 to 2500 psig. The reaction temperature can range from about 500° F. to about 950° F., especially from about 650° F. to about 850° F.

These reactions generally employ weight hourly space velocities of from about 0.05 to about 10. The invention will be further illustrated by reference to the following examples. They are provided to demonstrate the invention and are not to be construed as limiting its scope.

EXAMPLE I

A petroleum residua was prepared by atmospheric distillation of Arabian heavy crude petroleum. This residua had a gravity of 13.0, a sulfur content of 4.3% by weight, a metals content of 103 ppm. It contained more than 95% by weight of materials boiling above 600° F.

This material was used as feedstock for a laboratory scale hydroprocessing reactor. The reactor had a fixed bed of a particulate supported nonprecious metal hydroprocessing catalyst. The reactor was run at a total pressure of 2000 psig of which the pressure of added hydrogen was about 1800 psia. The liquid weight throughput based on catalyst weight was 0.75/,hrs$^{-1}$, and the hydrogen throughput was equivalent to 5000 scf/bbl. The reactor was run at a temperature of 700°-725° F. during the first 350 hours. From 350 to 460 hours the temperature was 750° F. From 460 to 720 hours the temperature was 725° F. For the remainder of the run (and all periods when the comparative data were taken) the temperature was 750° F. During the initial 560 hours of the run no fluorine was added to the feed. Then for about 360 hours 250 ppm wt of fluorine as trifluorotoluene was added to the feed. Next, for about 300 hours 1500 ppm of fluorine as trifluorotoluene was added, followed by about 100 hours without fluorine and 150 hours with 1500 ppm of fluorine. The activity of the catalyst for hydrodemetallation and hydrodesulfurization was monitored by analyzing the feed and periodically analyzing the product for metals and sulfur. Hydrocracking activity was monitored by measuring product gravity. Rate constants were calculated. FIG. 1 shows the hydrodesulfurization reaction rate constant observed over the run period. Slopes of decrease are shown as well. As this shows, the rate of decrease was lower, that is, the catalyst was more stable, during periods when fluorine was being added. Cracking was observed as well. It was also noted that hydrodemetallation activity remained more constant when fluoride was added. Based on these results it was projected that catalyst life could be extended by at least a factor of two by fluoride addition to the residuum feed.

EXAMPLE II

The experiment of Example I is repeated with two changes. As base feedstock is used an Alaskan North Slope vacuum residuum having a sulfur content of 2.3%, a metals content of 120-140 ppm and a gravity of about 20 and as fluorine source is used 400 ppm of tetrafluorohexane. Results illustrating the effectiveness of the invention similar to those of Example I would be observed.

What is claimed is:

1. In the hydroprocessing of a sulfur-containing heavy petroleum feedstock containing from about 50 to about 2000 ppm metals and 0.5 to 10% by weight of organic sulfur and said feedstock being residua bottom-fraction selected from the group consisting of vacuum residua, atmospheric residua and mixtures thereof wherein said feedstock is contacted with a heterogeneous catalyst having a support comprising alumina and added hydrogen at a temperature of 500°-1000° F., thereby forming a hydroprocessed product the improvement comprising admixing with said feedstock prior to said contacting from 50 to 1500 ppm by weight, basis feedstock, of fluorine as an organofluorine compound so as to extend the effective life of said heterogeneous catalyst having a support comprising alumina.

2. The process of claim 1 wherein said hydroprocessing comprises catalytic hydrodesulfurization.

3. The process of claim 2 wherein said heterogeneous catalyst comprises nonprecious metal on an alumina-containing support.

4. The process of claim 3 wherein said organofluorine compound is selected from the alkyl and aryl fluorides.

5. The process of claim 3 wherein said organofluorine compound is an aryl, alkaryl or aralkyl fluoride containing from 6 to 16 carbons and from 1 to 8 fluorines per molecule.

6. The process of claim 1 wherein said organofluorine compound is trifluorotoluene.

7. The process of claim 3 wherein said organofluorine compound is trifluorotoluene.

8. The process of claim 6 wherein said catalyst comprises nickel and molybdenum or cobalt and molybdenum on an alumina support.

9. The process of claim 7 wherein said catalyst comprises nickel and molybdenum or cobalt and molybdenum on an alumina support.

10. The process of claim 1 wherein the metals include nickel and vanadium.

* * * * *